United States Patent [19]

Kim

[11] Patent Number: 4,712,539

[45] Date of Patent: Dec. 15, 1987

[54] PRESSURE APPLYING APPARATUS

[76] Inventor: Jung J. Kim, 1916 Stanley Ave., Rockville, Md. 20851

[21] Appl. No.: 748,827

[22] Filed: Jun. 26, 1985

[51] Int. Cl.[4] ..... A61H 15/00

[52] U.S. Cl. ..... 128/57; 128/67

[58] Field of Search ..... 128/57, 62 R, 67; D24/36

[56] References Cited

U.S. PATENT DOCUMENTS

| | | | |
|---|---|---|---|
| D. 248,493 | 7/1978 | Moncrief | 128/57 |
| D. 249,551 | 9/1978 | Greenawalt | 128/57 |
| 472,572 | 4/1892 | Forest | 128/57 |
| 896,484 | 8/1908 | Thomas | 128/57 |
| 1,688,764 | 10/1928 | Trankowski et al. | 128/57 |
| 2,221,785 | 11/1940 | Douglas | 128/57 |
| 3,616,794 | 11/1971 | Gromala | 128/57 |
| 4,433,683 | 2/1984 | McCoy et al. | 128/57 |

FOREIGN PATENT DOCUMENTS

| | | | |
|---|---|---|---|
| 451682 | 10/1927 | Fed. Rep. of Germany | 128/57 |
| 44645 | 10/1983 | Rep. of Korea . | |
| 7504998 | 11/1976 | Netherlands | 128/67 |

*Primary Examiner*—Edgar S. Burr
*Assistant Examiner*—Tonya Lamb
*Attorney, Agent, or Firm*—James Creighton Wray

[57] ABSTRACT

Therapeutic devices for applying pressure to various muscles and other parts of the body having a plurality of disc-shaped rolling elements rotatably mounted on a shaft and disposed between nonrotating handles. In one embodiment, a symetrically curved rolling element centrally disposed between smaller disc-shaped rolling elements is configured to apply pressure to certain areas of the body.

7 Claims, 6 Drawing Figures

2
6
10
8
4
12

22
18
2
32
D
C
B
A
24
28
30
26
34
4
20
16
14

58
36
38
40
44
48

44
46
36
40
42
38
48

PRESSURE APPLYING APPARATUS

BACKGROUND OF THE INVENTION

The present invention applies to the related sciences of accupuncture, accupressure, chiropractic, and massotherapy.

Accupuncture and accupressure use external stimulation of various points on the body to achieve therapeutic results. In accupuncture, stimulation requires penetration of the skin with needle-like devices. On the other hand, accupressure requires the application of pressure to certain pressure points or areas, and also the accupuncture lines.

The pressure areas or points relate to the twelve meridians of the body. The meridians include the heart, pericardium, spleen, kidney, bladder, small intestine, large intestine, lung, liver, gall bladder, stomach, and tripple wamer. Each meridian constitutes a distinct pressure area within the abdomen. Therapeutic results may be achieved by applying pressure directly to any of the twelve meridians.

It is known to those skilled in the science of accupuncture that the same organs which were described as the twelve meridians can be treated by stimulating the various known accupuncture lines which run throughout the body. In accupressure, pressure can be applied to the accupuncture lines to obtain therapeutic results.

Devices used to apply pressure to the various pressure points and lines associated with accupuncture or accupressure are known.

SUMMARY OF THE INVENTION

The present invention provides devices having multiple rolling surfaces and thrusting surfaces. A mid-portion is rotatably mounted on a shaft and has inner disc-shaped rolling surfaces that are spaced apart specifically to provide a rolling surface for the neck. The spacing permits the application of pressure to the various pressure points and areas of the neck without putting pressure on any of the neck bones. Also, the spacing permits massotherapeutic use of the device to the muscles of the neck which surround the spine.

The mid-portion also has a second pair of larger disc-shaped rolling elements which are spaced sufficiently outward from the inner rolling elements so as not to interfere with the function of the inner disk. The large rolling elements are spaced apart sufficiently to encompass the spine without touching it. Massotherapeutic results are obtained by rolling the larger rolling element up and down over the muscles that are adjacent the spine. Also, pressure areas which correspond to accupuncture lines along the spine can be stimulated to achieve further therapeutic results.

Korean Pat. No. 44,645 describes a device having a central rolling portion with widely spaced rolling discs.

While the device has proven useful, it is not capable of providing multiple rolling surfaces designed to accommodate specific pressure areas of the body. For instance, the neck has pressure areas that correspond to the heart, pericardium, kidney, large intestine, stomach, small intestine, gall bladder, tripple wamer and bladder. The Korean patent teaches a device that might apply pressure to the neck, but due to the spacing of the middle rolling elements, it would be difficult to apply pressure without pressing on bone areas.

The feet have pressure areas which require different rolling surfaces than the neck. The Korean patent does not provide a rolling surface specifically for the feet, nor is it contemplated to apply non-rolling pressure, such as thrusts inwardly at designated pressure areas.

Another device, shown in U.S. Pat. No. 3,750,654 is designed only for use in stimulating the first lines of the bladder meridian. To this end, the device is provided with two bulbous mid-portions and end portions that flare outward to a diameter approximately equal to the diameter of the bulbous mid-portions.

No prior device has contemplated multiple rolling surfaces adapted for use on different areas of the body.

Flanking the mid-portion are two rotatably mounted side portions, each consisting of a plurality of smaller disc-shaped elements. In one embodiment, the side portions are each of one piece construction with a plurality of radially extending rolling surfaces. Handles are provided at opposite ends of the shaft to retain the rolling elements on the shaft and to provide gripping means for the user.

In another embodiment of the invention, the device has a single handle at one end of the shaft, a plurality of disc-shaped elements, and an end cap at the opposite end of the shaft.

Both embodiments have rounded ends to provide thrusting pressure means.

It is an objection of the invention to provide an apparatus for use in the related sciences accupressure, chiropractice, and massotherapy, for applying pressure to designated pressure points and areas of the body to obtain therapeutic results, comprising, a central shaft, two handles, one fixedly supported at each of the opposite ends of the shaft, a spool-shaped mid-portion, rotatably supported on the shaft, and having two relatively large diameter outer discs defining a first rolling element for applying pressure to the back area of a user, and having two relatively small diameter inner discs, spaced inwardly from the outer discs, defining a second rolling element for applying pressure to the neck area of a user, and two opposite side portions, each rotably supported on the shaft between proximal ends of the handles and distal ends of the mid-portion and having a plurality of radially extending rolling surfaces, defining third and fourth rolling elements for applying pressure to the foot area of a user, the distal ends of the handles being rounded to provide blunt pressure applying means for applying pressure to various points and areas of the body by applying light thrusts to the body.

In another embodiment of the invention the outer discs are spaced apart a distance of approximately 9 centimenters from each other, and have a diameter of approximately 5 centimenters, and the inner discs are spaced apart a distance of approximately 4.5 centimeters from each other and approximately 2 centimeters from each outer disc, and have a diameter of approximately 4.5 centimeters.

In another embodiment of the invention the side portions are between 5 and 8 centimeters long, and the rolling surfaces extend to a diameter of approximately 3 centimeters.

In another preferred embodiment, each opposite side portion comprises a plurality of individual discs rotably supported on the shaft, each disc having opposite flat abutting surfaces and opposite angled surfaces, extending from the abutting surfaces, and converging at a circumferential rolling surface.

In another embodiment, each opposite side portion having a plurality of integrally formed discs, each side portion has opposite flat abutting surfaces and a series of converging oppositely angled grooves that define a plurality of circumferential rolling surfaces, the rolling surface having a width of approximately 1 millimeter and the discs have a diameter of approximately 3 centimeters.

In another embodiment, the central shaft is a hollow metal tube.

In another embodiment the central shaft is a solid metal rod.

In another embodiment the spool-shaped mid-portion, the two opposite side portions, and the two handles are made of wooden material.

In another embodiment the spool-shaped mid-portions, the two opposite side portions, and the two handles are made of plastic material.

Another object of the invention is to provide an improved apparatus for use in the related sciences of accupressure, chiropractic and massotherapy, having a pressure-applying rotatable mid-portion supported on a central shaft disposed between two handled fixedly supported on the central shaft, the improvement comprising, a spool-shaped mid-portion rotatably supported on the shaft, and having two large diameter outer discs defining a first rolling element for applying pressure to the back area of a user, and two inner discs of smaller diameter, spaced inwardly from the outer discs, defining a second rolling element for applying pressure to the neck area of a user, two opposite side portions, each being rotatably supported on the shaft between proximal ends of the handles and distal ends of the mid-portion having a plurality of radially extending rolling surfaces are defined by the third and fourth rolling elements for applying pressure to the foot area of a user, the distal ends of the handles being rounded to provide blunt, pressure applying means for applying pressure to various points and areas of the body by applying light thrusts to the body.

Another objective of the invention is to provide an apparatus for use in the related sciences of accupressure, chiropractic and massotherapy, for applying pressure to designated pressure points and areas of the body to obtain therapeutic results, comprising a central shaft, a substantially cylindrical handle fixedly supported at one end of the shaft and a plurality of disc-shaped rolling elements, rotatably supported on a length of the shaft, a substantially cylindrical end cap fixedly supported at the opposite end of the shaft, the end cap and the handle providing retaining means for retaining the plurality of disc-shaped rolling elements on the shaft.

In another embodiment, each disc-shaped rolling element comprises a disc having opposite flat abutting surfaces, and opposite angles surfaces extending from the abutting surfaces which converge at a circumferential rolling surface, the rolling surface having a width of approximately 1 millimeter, and the discs having a diameter of approximately 3 centimeters.

In another embodiment the apparatus further comprises an enlarged disc-shaped rolling element having the same shape as the others and being rotatably supported on the shaft between a proximal end of the end cap and the disc-shaped rolling element being the most distant from the handle.

In another embodiment of the invention, the distal ends of the end cap and handle are rounded to provide blunt, pressure applying means for applying pressure to various points and areas of the body by applying light thrusts to the body.

In another embodiment, the shaft is a hollow metal tube and all other elements are made of wooden material.

In another embodiment of the invention, the number of disc-shaped elements is 17 and the handle is approximately 9 centimeters long and approximately 2.5 centimeters wide, the end cap is approximately 3.5 centimeters long and approximately 2.5 centimeters wide, and the entire apparatus is approximately 32 centimeters long.

In another embodiment of the invention, the end cap and handle are grooved.

In another embodiment the distal ends of the shaft extend approximately to distal ends of the end cap and handle.

In another embodiment, larger disc-shaped elements are rolled up and down the spine, and also from side to side in circular motions to further the massotherapeutic action of the device.

DETAILED DESCRIPTION OF THE DRAWINGS

Figure 1:
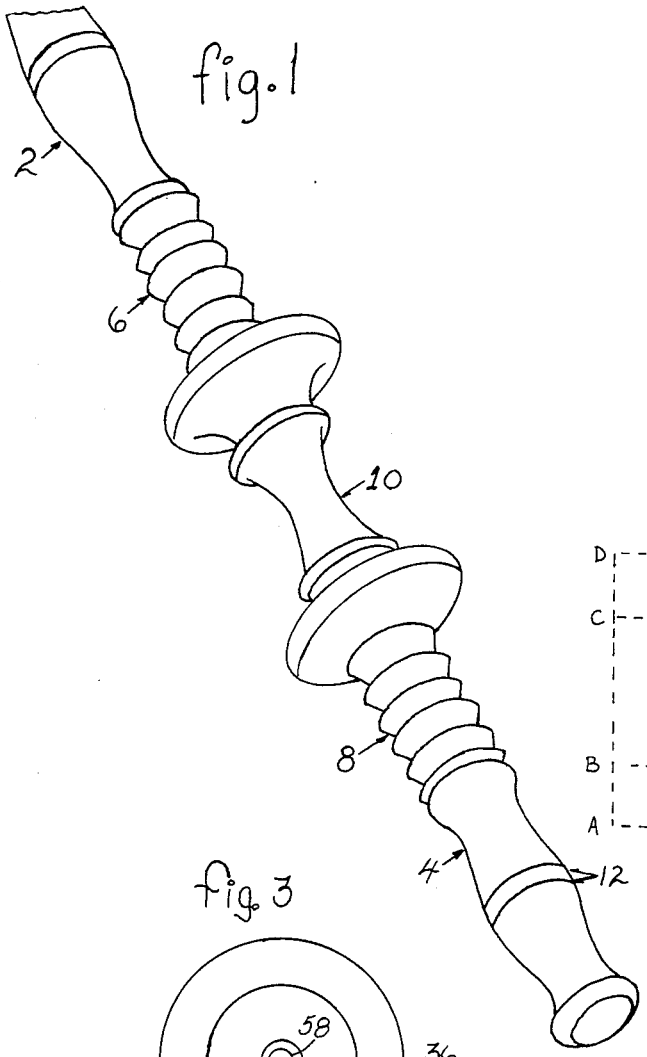
FIG. 1 is a perspective view of a preferred embodiment of the invention.

Referring now to FIG. 1, a preferred embodiment of the invention is shown perspectively. The basic elements are handles 2,4 disposed at opposite ends of the apparatus, opposite side portions 6,8, mounted for rotation between the handles, and a spool-shaped mid-portion 10, mounted for rotation between the side portions 6,8. The grips 2,4 may be provided with parallel grooves 12.

Figure 2:
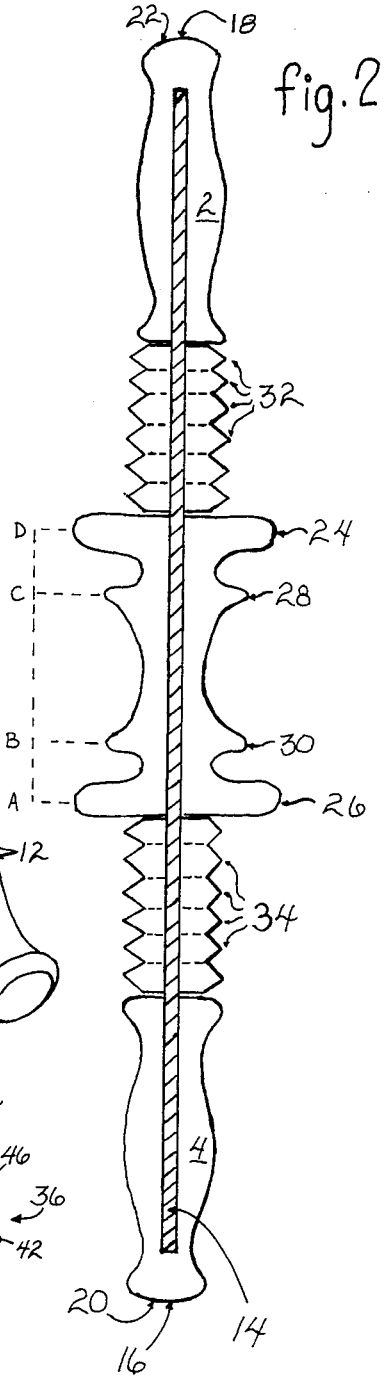
FIG. 2 is a longitudinal cross-section of the embodiment of FIG. 1.

FIG. 2 is a longitudinal cross-sectional view of the embodiment of FIG. 1. It can now be appreciated that all of the respective elements are supported on a central shaft 14. Handles 2,4 are fixedly supported on the shaft at opposite ends thereof, and preferably, distal ends 16,18 of the shaft extend to distal ends 20,22 of the handles. The distal ends of the handles have rounded profiles to provide additional pressure applying surfaces.

The mid-portion 10 has critical dimensions specifically intended to straddle certain bones of the body and to apply pressure to the muscles surrounding the straddled bones. To effect this purpose, the mid-portion 10 is provided with relatively large discs 24, 26 which are spaced apart by a distance equivalent to the distance between points A and D, shown in FIG. 2 by broken lines. The preferred distance between A and D is approximately 9 centimeters. This enables the device to be used to apply pressure to the muscles on either side of the spine simultaneously.

Spaced inwardly from the large diameter outer discs are inner discs 28,30. These, too, are spaced precisely to enable that portion of the device to serve a specific purpose. The spacing is shown in FIG. 2 by the distance between points B and C. Preferably, this distance is approximately 4.5 centimeters. This enables the device to be used to apply pressure to the muscles of the neck without directly contacting or applying pressure to the bones of the neck.

Side portions 6,8, are illustrated in FIG. 2 as having a plurality of radially extending surfaces 32,34. Preferably, the diameter of the radially extending surfaces approximates that of the handles 2,4, but is substantially smaller than the diameter of outer discs 24,26. Otherwise, circumferential surfaces of the radially extending surfaces would diminish the pressure-applying impact of the circumferential surfaces of the discs 24,26.

The side portions 6,8 may be unitary elements or they may be formed by a plurality of disc-shaped elements.

Figure 3:
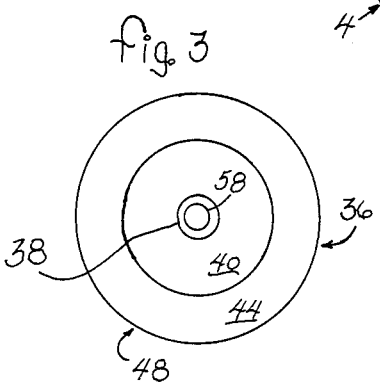
FIG. 3 is a plan view of a disc used in the invention.
Figure 4:
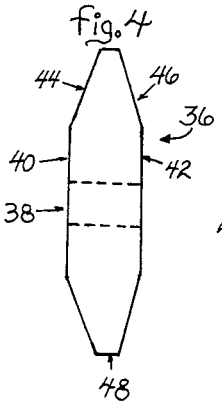
FIG. 4 is a cross-sectional view of FIG. 3.

FIGS. 3 and 4 illustrate features of the individual disc-shaped elements, referred to by the numeral 36. The element 36, shown in a plan view in FIG. 3, has a central bore 38 for receiving the shaft 14, flat abutting surfaces 40,42, and oppositely angled surfaces 44,46 which extend in opposite directions form the abutting surfaces and converge at circumferential rolling surface 48, which corresponds to radially extending surfaces 32, 34 in FIG. 2.

The cross-sectional view made available by FIG. 4 shows both opposite sides of the element 36, and the central bore 38 in broken lines. While the converging surfaces 44,46 preferably form a rolling surface 48 of approximately 1 millimeter in diameter, they may converge to a point, in which case, the rolling surface is acute.

Figure 5:
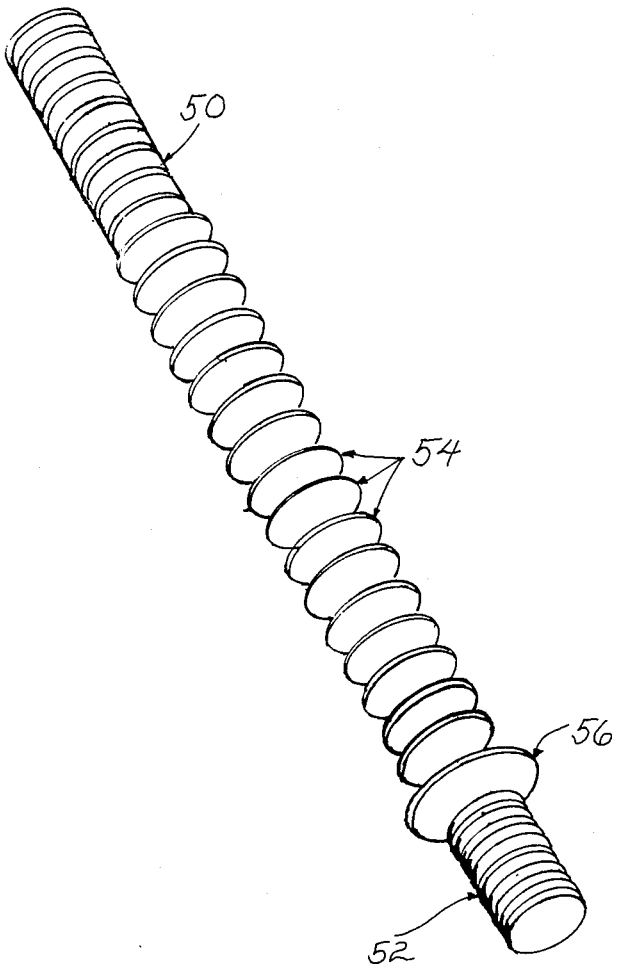
FIG. 5 is a perspective view of a preferred embodiment of the invention.

FIG. 5 illustrates another preferred embodiment of the invention in a prespective view. In this embodiment, the device is provided with a handle 50 attached to one end of the device and an end cap 52 attached to the opposite end. Between elements 50 and 52 are a plurality of disc-shaped rolling elements 54 which, unlike elements 50 and 52, are supported for rotational movement. Near a distal end, an enlarged rolling element 56 is also supported for rotational movement.

Figure 6:
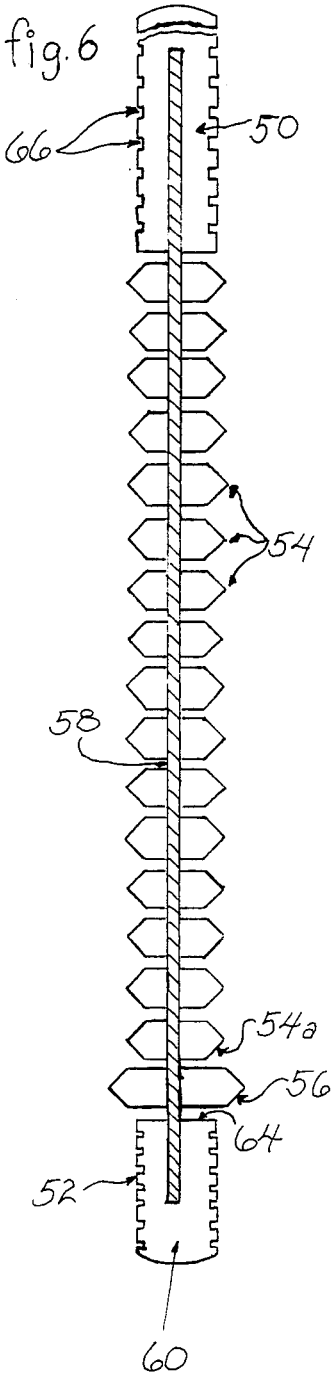
FIG. 6 is a longitudinal cross-section of the embodiment of FIG. 5.

Referring now to FIG. 6, the embodiment of FIG. 5 is shown in longitudinal cross section. The handle 50 is fixedly attached to a distal end of shaft 58. As illustrated, the distal ends of shaft 58 do not extend to the distal ends 60, 62 of the end cap and handle, respectively. The shaft 58 is illustrated as a solid metal rod, but a hollow metal tube may be used instead such as the shaft 14 as shown in FIG. 3.

The disc-shaped rolling elements 54 are the same as those illustrated in FIGS. 3 and 4. Enlarged element 56 is disposed at a distal end of the shaft 58 between a proximal end 64 of the end cap 52 and the rolling element 54a being spaced the greatest distance from handle 50.

In a similar fashion to the embodiment of FIGS. 1 and 2, the axial ends 60, 62 of end cap 52 and handle 50, respectively, are used to apply pressure to designated points and areas of the body. Also, elements 50, 52 can be provided with grooves 66 which act to make a grip for the handle 50. The device operates to apply pressure within the 12 "meridians" of the body, which are know to those familiar with the art. The meridians include the heart, pericardium, spleen, kidney, bladder, small intestine, large intestine, lung, liver, gall bladder, stomach, and tripple wamer.

The abdomen has pressure points or areas that correspond to each meridan.

Methods of using the device include breathing in, placing one axial end of the device at a designated pressure point, and pressing inwardly. After holding breath for approximately 5 seconds, slow exhale is accompanied by a slow release of pressure from the device.

Another possible application of the device is to lay down with the back on the floor with the knees bent, then place the device on the back with the mid-portion over the spinal line, then applying pressure by pressing down with body weight. Finally, twisting to the left and right holding the position on each side for 5 to 10 seconds.

Another application is to take the device and roll it down from the shoulder down the arm, repeating this movement for 30 seconds. Afterwards, strike sections of the shoulder, arm and hand lightly.

For application to the rib cage, the device is used in an up and down motion.

For application to the foot, place the device on the floor and step on the side portions and roll the device under the foot.

For application to the neck, the head must be tilted away from the area to be contacted. The mid portion of the device is used in an up and down rolling motion. Other applications to the neck include holding the mid portion against the back of the neck without rolling, for about 30 seconds.

From the foregoing description, one skilled in the art can easily ascertain the essential characteristics of this invention, and without departing from the spirit and scope thereof, can make various changes and modifications of the invention to adapt it to various usages and conditions.

For instance, either or both the larger and smaller disc-shaped rolling elements may be provided with rubber or other pliable material annular attachments to soften the outer rolling surfaces. Also, all rolling surfaces and disc-shaped rolling elements of both embodiments may be made of rubber, as well as plastic, wood or metal.

What I claim is:

1. In an apparatus for use in the related sciences of accupressure, chiropractic and massotherapy, having rolling elements supported on a central shaft disposed between two handles fixedly connected to opposite ends of the central shaft, the improvement comprising:

a first accupressure means for back-massaging comprising a rolling mid-portion, rotatably supported on the shaft, and having two widely spaced, relatively large diameter outer discs defining a first rolling element for applying pressure to the back area of a user, and second accupressure means for neck-massaging comprising a long concave portion axially outwardly terminated by two inner discs having a diameter smaller than the outer discs, and being spaced slightly inwardly from the outer discs, defining a second rolling element for applying pressure to the neck area of a user, the inner discs being separated by the long concave portion which has a radially inwardly uniformly curved surface which is concave in cross-section, the first means for back massaging and the second means for neck massaging comprising a unitary rolling element, two accupressure means for foot-massaging comprising two opposite independently rolling side portions, each being independently rotatably supported on the shaft between flat proximal ends of the handles and flat distal ends of the mid-portion and having a plurality of radially extending thin outer edge rolling surfaces sloping inwardly to solid inner cores and defining third and fourth independently rolling elements for applying pressure to the foot area of a user, the handles being solid and distal ends of the handles being rounded to provide blunt, pressure applying means for applying pressure to various points and areas of the body by applying light thrusts to the body.

2. An apparatus for use in the related sciences of accupressure, chiropractic, and massotherapy, for applying pressure to designated pressure points and areas of the body to obtain therapeutic results, comprising:

a central shaft, two handles, one fixedly supported to the shaft at each of the opposite ends thereof, a first accupressure means for back-massaging comprising a hard rolling mid-portion, rotatably supported on the shaft, and having two relatively large diameter outer discs with relatively large radius curved convex surfaces and flat axially outward radial faces defining a first rolling element for applying pressure to the back area of a user, and second accupressure means for neck-massaging comprising a long uniformly curved concave central portion for contacting a neck, the long central portion outwardly terminating in two inner discs, having a smaller diameter than the outer discs and being spaced slightly axially and radially inwardly from the outer discs, defining a second rolling element for applying pressure to the neck area of a user, the first and second rolling elements being integral with each other and being mounted for rolling on the shaft, two accupressure means for foot-massaging comprising two oppositely independently rolling side portions, each being independently rotatably supported on the shaft between proximal ends of the handles and distal ends of the mid-portions and each independently rotatable massaging side portion having a plurality of radially extending thin outer edge rolling surfaces, the side portions defining third and fourth independently rolling elements for applying pressure to the foot area of a user, the handles being rigid elements having smoothly curved concave and convex radially outward surfaces and distal ends of the handles being rounded to provide blunt pressure applying means for applying pressure to various points and areas of the body by applying light thrusts to the body.

3. The apparatus of claim 2 wherein each opposite side portion comprises a plurality of integrally formed discs, each side portion having opposite flat abutting surfaces and a series of converging oppositely angled grooves that define a plurality of thin circumferential rolling surfaces.

4. The apparatus of claim 2 wherein the outer discs are spaced apart a distance of approximately 9 centimeters from each other and have a diameter of approximately 5 centimeters, and wherein the inner discs are spaced apart a distance of approximately 4.5 centimeters from each other and approximately 2 centimeters from each outer disc, and have a diameter of approximately 4.5 centimeters.

5. The apparatus of claim 4 wherein the side portions are between 5 and 8 centimeters long, and the rolling surfaces extend to a diameter of approximately 3 centimeters.

6. The apparatus of claim 2 wherein each opposite side portion comprises a plurality of individual discs rotatably supported on the shaft, each disc having opposite flat abutting surfaces and opposite angled surfaces, extending from the abutting surfaces, and converging at a thin circumferential rolling surface.

7. The apparatus of claim 6 wherein the rolling surface has a width of approximately 1 millimeter, and the discs have a diameter of approximately 3 centimeters.

* * * * *